US010924863B2

(12) United States Patent
Hu et al.

(10) Patent No.: US 10,924,863 B2
(45) Date of Patent: Feb. 16, 2021

(54) DIAPHRAGM AND SPEAKER

(71) Applicant: AAC Technologies Pte. Ltd., Singapore (SG)

(72) Inventors: Hongjian Hu, Shenzhen (CN); Shuai Li, Shenzhen (CN); Min Su, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/527,070

(22) Filed: Jul. 31, 2019

(65) Prior Publication Data

US 2020/0045435 A1 Feb. 6, 2020

(30) Foreign Application Priority Data

Aug. 4, 2018 (CN) ..... 201821255679.9

(51) Int. Cl.
*H04R 7/20* (2006.01)
*H04R 9/06* (2006.01)
*H04R 7/12* (2006.01)

(52) U.S. Cl.
CPC ..... *H04R 7/20* (2013.01); *H04R 7/127* (2013.01); *H04R 9/06* (2013.01)

(58) Field of Classification Search
CPC . H04R 9/06; H04R 7/127; H04R 7/20; H04R 7/12
USPC ..... 381/398, 394, 412, 430, 423, 426
See application file for complete search history.

(56) References Cited

U.S. PATENT DOCUMENTS 4,709,392 A * 11/1987 Kato ..... H04R 7/26 181/157
2015/0016657 A1* 1/2015 Song ..... H04R 7/10 381/398
2017/0048622 A1* 2/2017 Wu ..... H04R 9/043
2018/0027333 A1* 1/2018 Mao ..... H04R 9/025 381/398
2018/0070168 A1* 3/2018 Han ..... H04R 31/006

* cited by examiner

*Primary Examiner* — Melur Ramakrishnaiah
(74) *Attorney, Agent, or Firm* — W&G Law Group LLP

(57) ABSTRACT

The present disclosure relates to the field of sound production, and provides a diaphragm including a dome and a suspension surrounding the dome. The dome includes a first surface fixedly connected to the suspension, and a second surface disposed opposite to the first surface and facing away from the suspension. The dome is provided with a through hole in communication with the first surface and the second surface, and the through hole is adjacent to edges of the dome but does not reach the edges of the dome. The present disclosure further provides a speaker including the diaphragm. The diaphragm and the speaker according to the present disclosure have the advantages of ensuring the strength of the dome while ensuring the leakage of the glue inside the speaker.

7 Claims, 2 Drawing Sheets

DIAPHRAGM AND SPEAKER

TECHNICAL FIELD

The present disclosure relates to the field of sound production, and in particular, to a diaphragm and a speaker.

BACKGROUND

With the advent of the mobile Internet era, the number of smart mobile devices is on the rise. Among the numerous mobile devices, a mobile phone is undoubtedly the most common and portable mobile terminal device. At present, functions of a mobile phone are extremely diverse, one of which is a high-quality music playback function, and a speaker in the mobile phone is one of necessary conditions to achieve this high-quality music function.

Generally, a speaker includes a holder forming a housing, a magnetic circuit unit fixed in the holder, and a vibration unit interacting with the magnetic circuit unit to vibrate. The magnetic circuit unit usually includes a yoke, a magnet fixed in the center of the yoke, and a magnetic gap formed between the yoke and the magnet. The vibration unit usually includes a voice coil partially extending into the magnetic gap and a diaphragm connected to the voice coil. The diaphragm includes a dome and a suspension surrounding the dome. When an electrical signal including an audio signal is fed into the voice coil, the voice coil interacts with the magnetic field of the magnetic circuit unit to produce an ampere force. Subject to the ampere force, the voice coil vibrates back and forth, which drives the diaphragm to vibrate and thus generates acoustic radiation. Parts of the speaker are usually connected to each other by a glue.

However, the inventor of the present disclosure has found that the parts of the speaker are glued together, during the gluing, excess glue will overflow to a surface of the diaphragm and occupy the space inside the speaker, and although it is possible that the excess glue will leak out by opening holes on edges of the dome during the manufacturing, the holes on the dome will reduce the strength of the dome.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding portions throughout the several views.

DESCRIPTION OF EMBODIMENTS

The present disclosure will be further illustrated with reference to the accompanying drawings and the embodiments.

Figure 1:
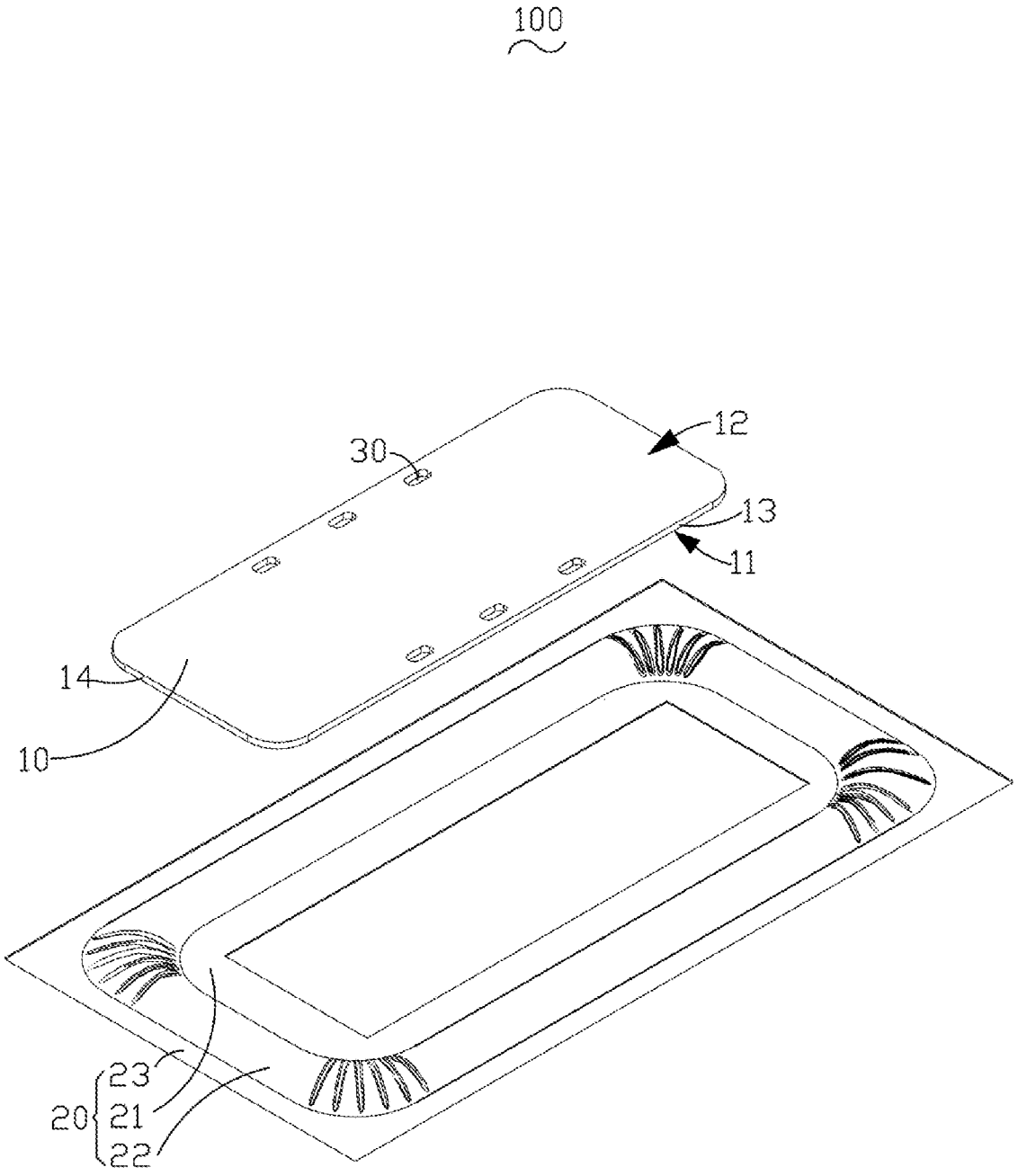
FIG. 1 is an exploded view of a diaphragm according to a first embodiment of the present disclosure.

A first embodiment of the present disclosure relates to a diaphragm 100, which, as shown in FIG. 1, includes: a dome 10 and a suspension 20 surrounding the dome 10. The dome 10 includes a first surface 11 fixedly connected to the suspension 20 and a second surface 12 disposed opposite to the first surface and facing away from the suspension 20.

The dome 10 is provided with through holes 30 in communication with the first surface 11 and the second surface 12, and the through holes 30 are adjacent to edges of the dome 10 but do not reach the edges of the dome 10. The suspension 20 includes a connection portion 21 fixedly connected to the first surface 11, a projecting portion 22 surrounding the connection portion 21, and an outer edge 23 surrounding the projecting portion 22.

Compared with the related art, according to the diaphragm 100 provided in the embodiment, through holes 30 are disposed on the dome 10, the through holes 30 are in communication with the first surface 11 and the second surface 12, and the through holes 30 are disposed adjacent to edges of the dome 10. As the dome 10 is fixed to the suspension 20 at the edges edge of the dome 10, the through holes 30 at the edges of the dome 10 can better facilitate the leakage of the glue inside the speaker. As the through holes 30 do not reach the edges of the dome 10, the influences of the through holes 30 on the strength of the dome 10 are reduced. Meanwhile, on the premise of guaranteeing the effective glue capacity of the through holes 30, the opening size of the through holes 30 do not reach the edges can be designed to be smaller than that of the gap opened at the edge, so as to further reduce the influences of the through holes 30 on the strength of the dome 10. Thus, the strength of the dome 10 is ensured while ensuring the leakage of the glue inside the speaker.

As an example, in this embodiment, there are multiple through holes 30, and the multiple through holes 30 are evenly spaced along the edges of the dome 10. As the multiple through holes 30 are evenly spaced along the edges of the dome 10, when the diaphragm 100 falls, the stress on the dome 10 can be evenly distributed without local excessive stress, thus effectively reducing the influences of the through holes on the strength of the dome.

Further, the dome 10 may be in a shape of a rounded rectangle. The dome 10 includes a pair of long sides 13 and a pair of short sides 14, and the multiple through holes 30 are symmetrically arranged about a midperpendicular of the long sides 13. When the multiple through holes 30 are symmetrically arranged about a midperpendicular of the long sides, the influences of the through holes 30 on the strength of the dome 10 in a direction of the long sides can be effectively reduced. It should be appreciated that the multiple through holes 30 can also be symmetrically arranged about a midperpendicular of the short sides 14. When the multiple through holes 30 are symmetrically arranged about a midperpendicular of the short sides, the influences of the through holes 30 on the strength of the dome 10 in a direction of the short sides can be effectively reduced. Definitely, the multiple through holes 30 can also be symmetrically arranged about a midperpendicular of the long sides 13 and about a midperpendicular of the short sides 14 at the same time, thus reducing the influences of the through holes 30 on the strength of the dome 10 in direction of the long sides and in the direction of the short sides at the same time.

Specifically, in this embodiment, the through holes 30 are in the shape of a rounded rectangle. Compared with the through holes in an ordinary rectangle, the through holes 30 in the shape of a rounded rectangle can effectively reduce the stress at the corner of the rectangle, affect the strength of the dome 10 less, and further improve the strength of the dome 10. Further, the through holes 30 may also be circular. Compared with the through holes in other shapes, the circular through holes 30 may affect the strength of the dome less, and further improve the strength of the dome. It should be appreciated that the shape of the through holes 30 can be selected according to actual requirements, which is merely for illustration and is not limited to the rounded rectangle or the circular shape.

It should be noted that in this embodiment, the dome 30 is adhered to the connection portion 21 by an adhesive. It should be appreciated that fixing the dome 30 to the connection portion 21 by an adhesive is only a fixing manner, and other fixing manners are also feasible. The fixing manner may be specifically selected according to actual situations, and will not be listed by exhaustion.

Figure 2:
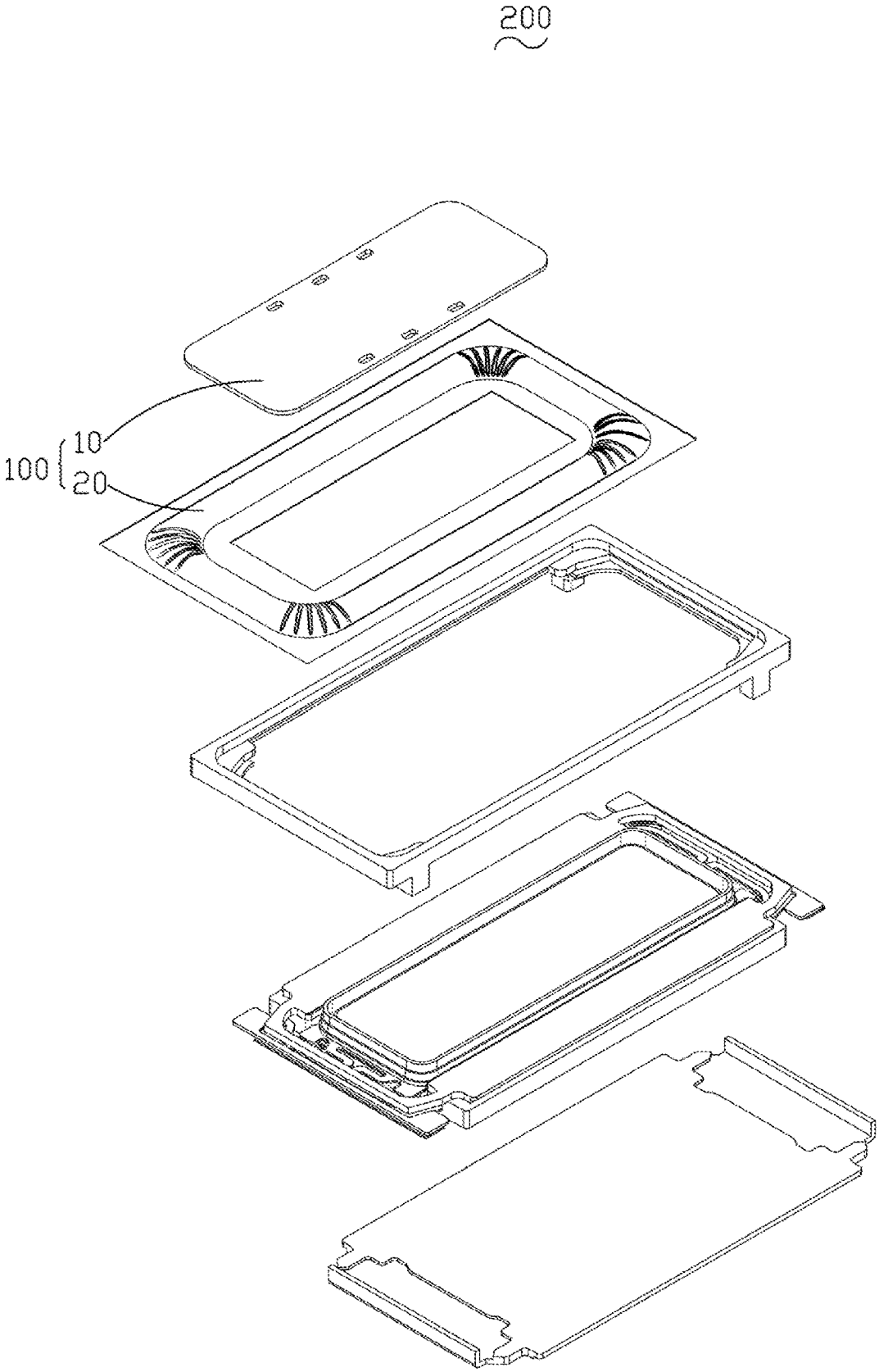
FIG. 2 is an exploded view of a speaker according to a second embodiment of the present disclosure.

In a second embodiment, the present disclosure provides a speaker 20, which, as shown in FIG. 2, includes the diaphragm 100 provided in the first embodiment. The diaphragm 100 includes a dome 10 and a suspension 20.

Those of ordinary skill in the art can appreciate that the above embodiments are specific embodiments for implementing the present disclosure. In actual applications, various changes can be made in the form and details without departing from the spirit and scope of the present disclosure.

What is claimed is:

1. A diaphragm, comprising:

a dome; and a suspension surrounding the dome, wherein the dome comprises a first surface fixedly connected to the suspension, and a second surface disposed opposite to the first surface and facing away from the suspension, the dome is provided with a through hole in communication with the first surface and the second surface, and the through hole is adjacent to edges of the dome but does not reach the edges of the dome the through hole is used for holding glue.

2. The diaphragm as described in claim 1, wherein a plurality of through holes is provided, and the plurality of through holes is evenly spaced along the edges of the dome.

3. The diaphragm as described in claim 2, wherein the dome is in a shape of a rounded rectangle, the dome comprises a pair of long sides and a pair of short sides, and the plurality of through holes is symmetrically arranged about a midperpendicular of the long sides and/or the short sides.

4. The diaphragm as described in claim 3, wherein the plurality of through holes has a circular shape.

5. The diaphragm as described in claim 3, wherein the plurality of through holes has a shape of a rounded rectangle.

6. The diaphragm as described in claim 1, wherein the dome is adhered to the suspension by an adhesive.

7. A speaker, comprising the diaphragm as described in claim 1.

* * * * *